US006289555B1

(12) United States Patent
Nguyen et al.

(10) Patent No.: US 6,289,555 B1
(45) Date of Patent: Sep. 18, 2001

(54) ADJUSTABLE HINGE ASSEMBLY

(75) Inventors: Tung Kim Nguyen; Joseph L. Rehm, both of Overland Park, KS (US)

(73) Assignee: Emerson Electric Company, St. Louis, MO (US)

( * ) Notice: Subject to any disclaimer, the term of this patent is extended or adjusted under 35 U.S.C. 154(b) by 0 days.

(21) Appl. No.: 09/268,417

(22) Filed: Mar. 15, 1999

(51) Int. Cl.[7] ..... E05D 7/04; F24F 7/007

(52) U.S. Cl. ..... 16/235; 16/237; 16/374; 220/810; 220/845

(58) Field of Search ..... 16/235–237, 239, 16/248, 250, 371, 374; 312/327, 328, 205; 49/505, 465; 248/346.01, 346.07, 678; 220/831, 832, 833, 835, 810, 845, 287; 403/3, 4; 454/358, 367, 339, 355

(56) References Cited

U.S. PATENT DOCUMENTS

| | | | | |
|---|---|---|---|---|
| 850,126 | * | 4/1907 | Bayley | 454/12 |
| 1,164,395 | * | 12/1915 | Reiselt | 269/63 |
| 2,536,235 | * | 1/1951 | Steelman et al. | 454/12 |
| 2,875,678 | * | 3/1959 | Shepherd | 454/355 |
| 3,960,063 | * | 6/1976 | Siemes et al. | 454/355 |
| 5,160,140 | * | 11/1992 | Starrett | 463/47.6 |
| 5,400,993 | * | 3/1995 | Hamilton | 248/279.1 |
| 5,816,909 | * | 10/1998 | Wunder | 454/355 X |

* cited by examiner

*Primary Examiner*—Anthony Knight
(74) *Attorney, Agent, or Firm*—Hovey, Williams, Timmons & Collins

(57) ABSTRACT

An adjustable hinge assembly is provided for use on a ventilator apparatus, wherein the ventilator apparatus includes a curb, a removable curb cap covering the curb and presenting side and rear edges, and a ventilator supported on the curb cap. The assembly includes a pair of laterally spaced curb cap support plates that each include a first arm adapted to be secured to the curb cap and extending along one of the side edges of the cap, and a second arm adapted to be secured to the curb cap and extending along the rear edge of the cap. The assembly also includes a back plate connected to and between the support plates along the rear edge of the cap, and a pair of laterally spaced curb plates adapted to be secured to the curb. The curb plates support the curb cap support plates, and define a pivot axis about which the curb cap support plates pivot between a first position in which the cap covers the curb, and a second position in which the cap is raised from the curb. At least one bracket is also provided with the assembly, and secures the back plate to the ventilator to support the ventilator during pivoting movement of the cap. The assembly is adjustable so that a single hinge assembly construction can be used universally with various sizes of ventilators.

28 Claims, 2 Drawing Sheets

ADJUSTABLE HINGE ASSEMBLY

CROSS-REFERENCE TO RELATED APPLICATIONS

"Not Applicable".

STATEMENT REGARDING FEDERALLY SPONSORED RESEARCH OR DEVELOPMENT

"Not Applicable".

BACKGROUND OF THE INVENTION

The present invention relates generally a hinge assembly for use on a receptacle closure and, more particularly, to an adjustable hinge assembly for use on a ventilator apparatus for supporting a ventilator end cap of the apparatus for pivotal movement between open and closed positions.

It is known to provide a ventilator apparatus for use on the roof of a building or other structure for venting warm air and other gases from the structure. An exemplary ventilator apparatus constructed for this purpose includes a centrifugal ventilator, a curb secured to the roof of the structure and protruding upward to define an interior plenum, and a cap that supports the ventilator on top of the curb and that is removable to permit access to the plenum for cleaning and service.

The curb is constructed over a hole or duct in the roof of the structure, and is typically rectangular in plan shape, including four upstanding side walls that surround the hole and define the plenum. The top of the curb is open, and the cap is sized for receipt over the curb so that the plenum is enclosed by the curb and cap. Preferably, the cap includes depending side walls that are received over the side walls of the curb to hold the cap in place, and a top wall presenting a hole over which the ventilator is received so that warm air or gases are drawn up through the plenum and the ventilator during operation, venting the gases to the atmosphere.

The ventilator of the exemplary apparatus is a centrifugal roof ventilator (CRV) designed for kitchen use, and is available in a number of different sizes, each presenting a lower venturi base having unique dimensions. The ventilator is fixed to the top wall of the cap, and moves with the cap when the cap is removed from the curb. It is conventional to provide a hinge assembly that is adapted to be connected between the cap and the curb for permitting the cap to be pivoted between a first position in covering relation to the curb, and a second position exposing the plenum of the curb for service and cleaning. It is also conventional to construct the hinge assembly with a first component secured to both the cap and the venturi base of the ventilator, a second component secured to the curb, and a hinge pin or the like for permitting relative pivotable movement between the components.

Several technical problems are encountered in the use of the conventional hinge assembly. For example, in order to permit the first component of the known hinge assembly to be connected to both the cap and the venturi base of the ventilator, it must be customized for use with each particular size of ventilator. As such, it is necessary to provide a different hinge assembly construction for each size of ventilator.

BRIEF SUMMARY OF THE INVENTION

It is an object of the present invention to solve this and other technical problems left unaddressed by the prior art, and to provide an adjustable hinge assembly that is capable of use with ventilators of various sizes. In addition, the adjustability of the hinge assembly also permits the assembly to be used on curbs of various sizes such that a single assembly can be installed on many different sizes of curbs, and used with several different sizes of ventilators.

In accordance with these and other objects evident from the following description of a preferred embodiment of the invention, an adjustable hinge assembly is provided for use on a ventilator apparatus, wherein the ventilator apparatus includes a curb, a removable curb cap covering the curb and presenting side and rear edges, and a ventilator supported on the curb cap. The assembly includes a pair of laterally spaced curb cap support plates, each including a first arm secured to the curb cap along one of the side edges, and a second arm secured to the curb cap along the rear edge of the cap.

A back plate is connected to and between the support plates, and a pair of laterally spaced curb plates are secured to the curb and define a pivot axis about which the curb cap support plates are supported for pivotal movement between a closed position in which the cap covers the curb, and an open position in which the cap is raised from the curb. Preferably, a number of adjustable brackets are also provided for securing the back plate of the assembly to the venturi base of the ventilator to support the ventilator in the open position of the cap.

By providing a construction in accordance with the present invention, numerous advantages are realized. For example, by providing an assembly in which a back plate is provided for securing two laterally spaced support plates together on the curb cap, a construction results in which the assembly can be fitted on curbs of various dimensions, rendering the assembly adaptable to different ventilator apparatuses. In addition, by providing brackets for securing the back plate of the assembly to the base of the ventilator, it is possible to adjust the positioning of the brackets on the back plate to tailor the assembly for use with different sizes of venturi bases.

BRIEF DESCRIPTION OF THE SEVERAL VIEWS OF THE DRAWING

The preferred embodiment of the present invention is described in detail below with reference to the attached drawing, wherein.

DETAILED DESCRIPTION OF THE INVENTION

Figure 1:
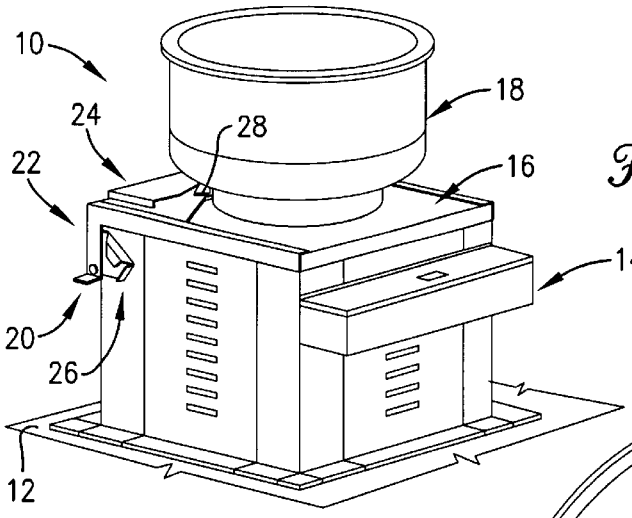
FIG. 1 is a perspective view of a centrifugal roof ventilator apparatus including an adjustable hinge assembly constructed in accordance with the preferred embodiment of the present invention, illustrating a cap of the apparatus in a closed position.

A centrifugal roof ventilator apparatus 10 is illustrated in FIG. 1, in position on the roof 12 of a structure such as a kitchen or the like, and broadly includes a curb 14 secured to the roof over a ventilation duct or opening, a cap 16 received on the curb, and a centrifugal roof ventilator 18 secured to the cap.

The curb 14 protrudes upward from the roof to define an interior plenum and is rectangular in plan shape, including four upstanding side walls that surround the hole and define the plenum. Preferably, each of the side walls includes one or more vents for venting pressure between the plenum and atmosphere. The top of the curb is open, as shown in FIG. 2, and the cap 16 is sized for receipt over the curb to enclose the plenum.

Preferably, the cap 16 includes depending front, side and rear walls that are received over the side walls of the curb 14 to hold the cap in place when in the closed position, and a top wall presenting a hole over which the ventilator is received so that warm air or gases are drawn up through the plenum and the ventilator during operation, venting the gases to the atmosphere.

The illustrated ventilator 18 is a CRV designed for kitchen use, and is available in a number of different sizes, each presenting a lower venturi base having unique dimensions. The ventilator is fixed to the top wall of the cap over the hole, and moves with the cap when the cap is removed from the curb.

Figure 2:
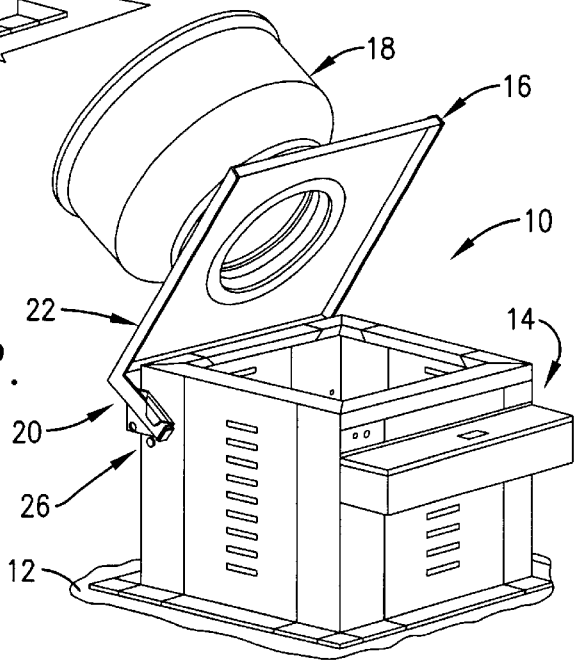
FIG. 2 is a perspective view of the apparatus, illustrating the cap in an open position.
Figure 3:
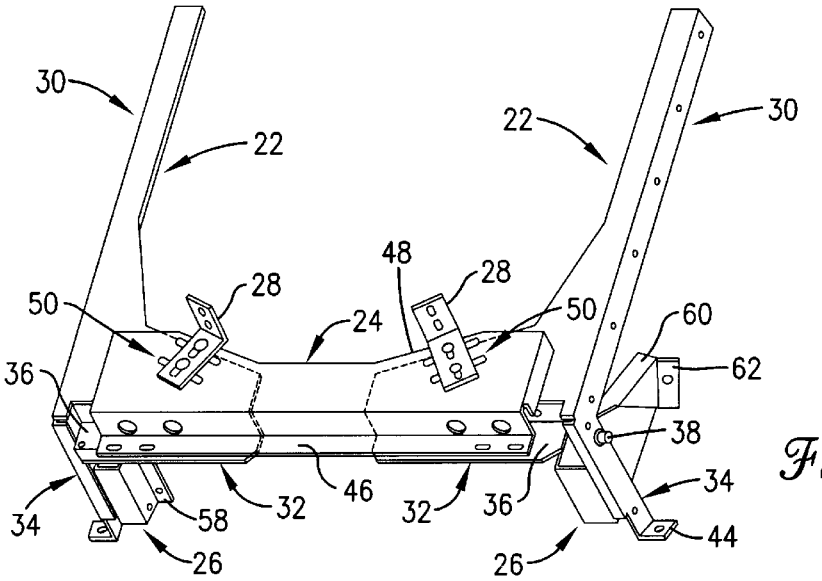
FIG. 3 is a perspective view of the hinge assembly.

An adjustable hinge assembly 20 constructed in accordance with the preferred embodiment is connected between the cap 16 and the curb 14 for supporting the ventilator on the cap, and for permitting the cap and ventilator to be pivoted as a unit between a closed position in covering relation to the curb, as illustrated in FIG. 1, and an open position, shown in FIG. 2, exposing the plenum of the curb for service and cleaning. The hinge assembly 20 is shown in FIG. 3, and broadly includes a pair of curb cap support plates 22 connected to the cap 16, a back plate 24 connected to and between the support plates, a pair of curb plates 26 connected to the curb and supporting the support plates for pivotal movement between the open and closed positions, and a plurality of L-shaped brackets 28 that are connected between the back plate and the venturi base of the ventilator 18 to support the ventilator when the cap is opened.

The support plates are similar to one another except that one of the support plates is constructed as a left-hand support plate and the other a right-hand support plate. Each support plate 22 includes a first elongated arm 30 adapted to be secured to the curb cap along one of the side edges of the cap, a second arm 32 adapted to be secured to the curb cap along the rear edge of the cap, and a depending leg 34 by which the support plate is connected to one of the curb plates, as described below. The first arm 30 includes a top wall and a side wall, both of which are formed by bending a piece of sheet metal or the like along a longitudinal axis of the arm. The top wall includes a distal end presenting a substantially constant width and a proximal end that merges with a top wall of the second arm 32. The side wall of the first arm 30 presents a substantially constant height, and includes a plurality of spaced holes sized for receipt of threaded fasteners or the like that are used to fasten the first arm to one of the side walls of the cap.

The second arm 32 of each support plate 22 extends in a direction generally perpendicular to the first arm, and includes a top wall that merges with the top wall of the first arm, and a rear wall that depends from the top wall. Preferably, the top wall of the second arm is unitary with the top wall of the first arm, and the rear wall is formed by bending the top wall about an axis transverse to the longitudinal axis of the first arm. A flange 36 extends from the lower edge of the rear wall to define a mounting surface that is substantially parallel to the top wall. The rear wall and flange of the second arm 32 are both provided with mounting holes or slots adapted to receive threaded fasteners or the like used to secure the back plate 24 to and between the support plates 22 during installation of the assembly.

Figure 4:
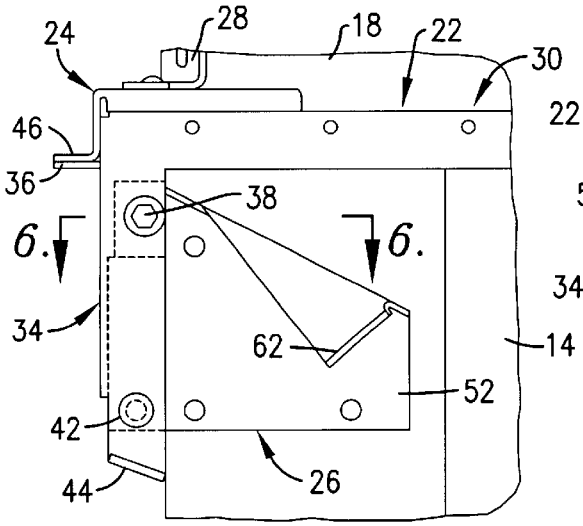
FIG. 4 is a fragmentary side elevational view of the apparatus, illustrating the cap in the closed position.
Figure 5:
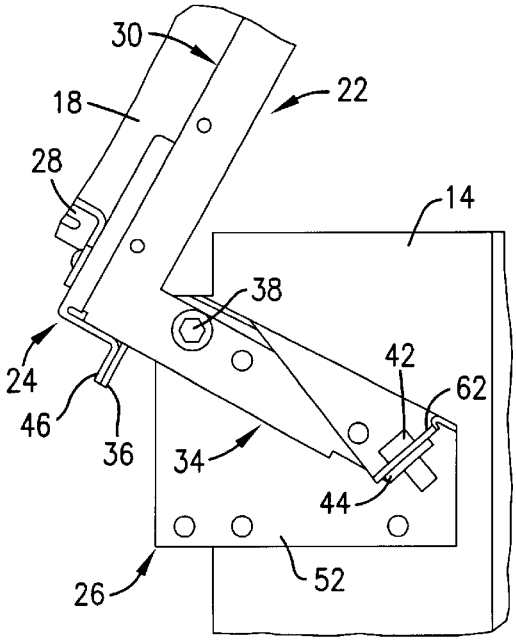
FIG. 5 is a fragmentary side elevational view of the apparatus, illustrating the cap in the open position.

The leg 34 of each support plate includes a side wall that is preferably unitary with the side wall of the first arm, and a rear wall that is bent inward from the rear edge of the side wall to provide rigidity to the leg. The side wall includes a first hole sized for receipt of a pivot pin 38 used to support the plate 22 on one of the curb plates 26 for relative pivotal movement, and a second hole 40 sized for receipt of a locking pin 42 that is used to lock the cap in the closed position, as shown in FIG. 4. In addition, a flange 44 is formed at the lower end of the leg by bending the side wall outward about an axis that is angled relative to the longitudinal axis of the first arm, and the flange includes a hole sized for receipt of the locking pin 42 to permit the cap to be locked in the open position, as shown in FIG. 5.

Returning to FIG. 3, the back plate 24 of the hinge assembly includes a generally planar top wall that spans the gap between the support plates along the rear edge of the cap, a rear wall depending from the top wall, and a mounting flange 46 protruding outwardly from the lower edge of the rear wall. The top wall includes a front edge 48 that is shaped to accommodate the venturi base of the ventilator, and two sets of laterally spaced hole or slot patterns 50 sized for receipt of threaded fasteners or the like that are used to secure the L-shaped brackets 28 in place on the back plate during installation of the assembly. Preferably, each set of holes or slots includes two or more pairs of elongated slots, wherein the slots of each pair are spaced from one another in a direction transverse to the longitudinal axes of the slots. In addition, each pair of slots are spaced from the adjacent pair in the set in a direction parallel to the lengths of the slots to permit the positions of the brackets on the back plate to be adjusted around the circumference of the ventilator. Likewise, the brackets each include a pair of slots in each of the legs thereof to permit the positions of the brackets on the back plate to be adjusted radially relative to the ventilator, as desired. Although the brackets are illustrated as being L-shaped, it is noted that brackets having other configurations may be substituted for those shown. For example, Z-shaped brackets or brackets of any other construction may be employed, if desired.

The top wall of the back plate is spaced vertically from the top wall of the support plates by a pair of depending side walls that are formed by bending the ends of the back plate top wall downward. As such, a space is defined between the support plates and the top wall of the back plate within which the threaded fasteners are received.

The rear wall and mounting flange 46 of the back plate 24 are generally planar, and each preferably includes a single set of holes or slots positioned to align with each of several sets of mounting holes or slots formed in the rear wall and mounting flange 36 of the support plates 22 such that threaded fasteners or the like may be used to secure the back plate to both of the support plates during installation of the assembly. As such, the lateral spacing between the support plates can be adjusted within a range of distances to accommodate curbs of various dimensions, and the back plate 24 can be fastened to the support plates once the spacing between the support plates is established to secure the support plates to one another and to the ventilator.

Figure 6:
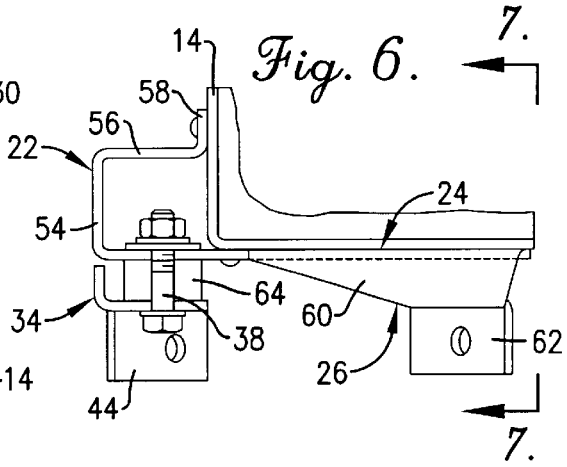
FIG. 6 is a sectional view taken along line 6—6 of FIG. 4.

The curb plates 26 are similar to one another except that one of the curb plates is constructed as a left-hand curb plate and the other a right-hand curb plate. As shown in FIG. 5, each curb plate includes a side wall 52 provided with a plurality of holes sized for receipt of threaded fasteners or the like that are used to secure the curb plate to one of the side walls of the curb adjacent the open upper end of the curb. Preferably, as shown in FIG. 6, the side wall is dimensioned so that a portion of the side wall protrudes beyond the rear edge of the curb, and a rear wall 54 is formed in the curb plate by folding the material of the plate laterally inward about a vertical axis. In addition, an inner side wall 56 is formed by again folding the rear wall about a second vertical axis, and a flange 58 is provided by making yet another bend in the material such that threaded fasteners or the like may be used to secure the flange to the rear side wall of the curb. By providing this preferred construction, the structural rigidity of each curb plate is substantially improved, providing support for the cap and ventilator during pivoting movement to the open position, as shown in FIG. 2.

Figure 7:
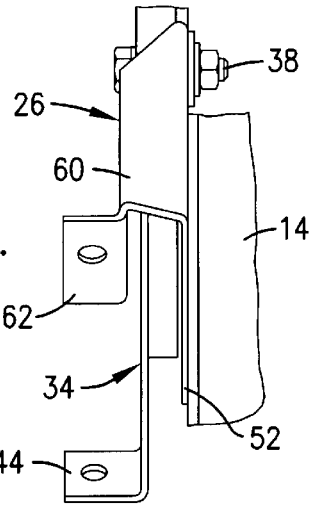
FIG. 7 is a fragmentary front end elevational view of the apparatus, illustrating the cap in the closed position.

Returning to FIG. 7, a top wall 60 is also provided on each curb plate, wherein the top wall is preferably formed by bending the material of the curb plate laterally outward about a line that is angled relative to horizontal, e.g. by an angle of about 20–30°. An outer side wall depends from the edge of the top wall, and is spaced from and parallel to the side wall of the curb plate so as to accommodate the leg of the corresponding curb cap support plate when the cap is pivoted to the open position shown in FIG. 5. In addition, the outer side wall of the curb plate presents an end flange 62 that bears against the flange 44 of the support plate leg 34 and defines a hole aligned with the hole in the flange 44 such that the locking pin 42 can be positioned through the flanges to lock the cap in the open position, as shown in FIG. 5.

With reference to FIG. 1, in order to install the assembly on a ventilator apparatus, the cap support plates 22 are first secured to the cap 16 on each side thereof, and the back plate 24 is fitted over the support plates so as to span the gap between the second arms of the plates along the rear edge of the cap. So long as the spacing between the support plates is within a predetermined range defined by the plurality of hole or slot sets formed in the plates 22, the hole or slot pattern on the back plate 24 will be aligned with at least one of the sets of holes or slots in each of the support plates, enabling the back plate to be securely fastened to both support plates. Likewise, the L-shaped brackets 28 are secured to the base of the ventilator and are aligned with the hole or slot sets in the top wall of the back plate so that the ventilator can be secured directly to the back plate, and indirectly to the support plates and cap. As such, a rigid connection is provided between the ventilator, the back plate, the support plates and the curb cap, facilitating pivoting of the cap and ventilator together as a unit.

The curb plates 26 are secured to the side walls of the curb 14 adjacent the open upper end thereof, and to the rear wall such that the plates provide a support for the cap support plates. Thereafter, as shown in FIG. 6, the support plates 22 are fastened to the curb plates 26 by the pivot pins 38 on which a spacer 64 is provided such that the support plates are permitted to pivot freely relative to the curb plates about the pins 38. The curb plates 26 are aligned vertically with one another so that the pivot pins are substantially collinear, facilitating free pivoting movement of the cap and ventilator between the open and closed positions.

The cap 16 can be locked in the closed position of FIG. 4 by inserting the locking pins 42 through the holes in the legs of the support plates 22 and the aligned holes in the curb plates 26, preventing relative pivotal movement. Likewise, the cap can be locked in the open position of FIG. 5 by inserting the locking pins 42 through the holes in the flanges 44, 62 when the cap is in the open position. Thereafter, the locking pins must be removed to permit relative movement of the cap.

Figure 8:
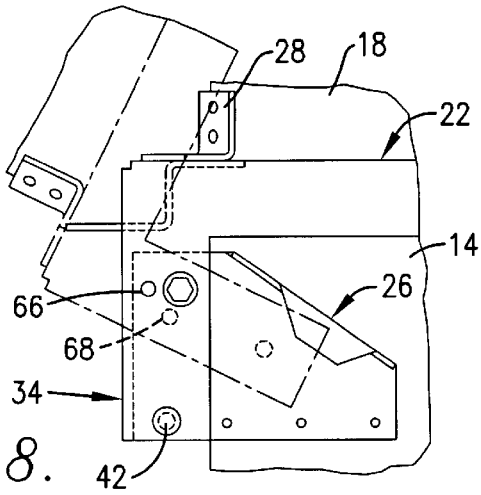
FIG. 8 is a fragmentary side elevational view of the apparatus, illustrating a hinge assembly constructed in accordance with an alternate embodiment of the present invention.

An alternate embodiment of the adjustable hinge assembly is illustrated in FIG. 8, and broadly includes the same components as described above with respect to FIGS. 1–7. However, in the embodiment of FIG. 8, the leg 34 of each curb cap support plate 22 is provided with an additional upper locking hole 66, and no flange is provided at the lower end of the leg. Likewise, the curb plates 26 are each provided with an additional upper locking hole 68. The lower holes in the legs and curb plates are aligned in the closed position of the cap, as shown in solid lines, such that the locking pin 42 can be inserted into the aligned holes to lock the cap in place, and the upper holes 66, 68 are aligned when the cap is opened, as shown in phantom lines, to permit the pin to be inserted therein to lock the cap in place.

Although the present invention has been described with reference to the preferred embodiment illustrated in the attached drawing figures, it is noted that substitutions may be made and equivalents employed herein without departing from the scope of the invention as recited in the claims.

What is claimed is:

1. An adjustable hinge assembly for pivotally coupling a cap to a curb, said adjustable hinge assembly comprising:

a pair of laterally spaced support plates, each including a first arm, a second arm, and a third arm, said first, second, and third arms extending generally orthogonally to one another, said first arm adapted to be coupled to the cap;

a back plate shiftably coupled to the second arms; and a pair of curb plates adapted to be fixedly coupled to the curb, each of said curb plates being pivotally coupled to a respective one of the third arms.

2. An adjustable hinge assembly as claimed in claim 1, further comprising a pair of flanges each protruding from a respective third arm, said flanges operable to limit the range of pivotal movement of the support plates.

3. An adjustable hinge assembly as claimed in claim 1, further comprising at least one bracket adapted to be secured between the back plate and the ventilator.

4. An adjustable hinge assembly as claimed in claim 3, wherein the back plate and the bracket each include a set of mounting holes by which the bracket can be secured to the back plate.

5. An adjustable hinge assembly as claimed in claim 4, wherein a least some of the holes are elongated slots.

6. An adjustable hinge assembly as claimed in claim 1, wherein the back plate and the second arms of the support plates each include a set of mounting holes by which the back plate can be secured to the support plates.

7. An adjustable hinge assembly as claimed in claim 6, wherein at least some of the holes are elongated slots.

8. An adjustable hinge assembly as claimed in claim 1, said curb plates and said third arms adapted to cooperatively define a pivot axis about which the cap can be pivoted relative to the curb between a closed position in which the cap covers the curb and an open position in which the cap is raised from the curb.

9. An adjustable hinge assembly as claimed in claim 8, further comprising a locking means for locking the support arms in the open position.

10. An adjustable hinge assembly as claimed in claim 8, wherein the support plates and the curb plates include holes that are aligned with one another in the open position of the support plates, the assembly further comprising a locking pin sized for receipt in the aligned holes to lock the support plates in the open position.

11. An adjustable hinge assembly as claimed in claim 8, wherein the support plates and the curb plates include holes that are aligned with one another in the closed position of the support plates, the assembly further comprising a locking pin sized for receipt in the aligned holes to lock the support plates in the closed position.

12. An adjustable hinge assembly for use on a ventilator apparatus, wherein the ventilator apparatus includes a curb, a removable curb cap covering the curb and presenting side and rear edges, and a ventilator supported on the curb cap, the assembly comprising:

a pair of laterally spaced curb cap support plates, each including a first arm adapted to be secured to the curb along one of the side edges of the cap, and a second arm adapted to be secured to the curb cap along the rear edge of the cap;

a back plate connected to and between the support plates along the rear edge of the cap, said support plates being adjustable relative to the back plate;

a pair of laterally spaced curb plates adapted to be secured to the curb and coupled to the support plates; and at least one bracket adapted to be secured between the back plate and the ventilator, said bracket being adjustable relative to the back plate.

13. An adjustable hinge assembly as claimed in claim 12, wherein the back plate and the bracket each include a set of mounting holes by which the bracket can be secured to the back plate.

14. An adjustable hinge assembly as claimed in claim 12, wherein a least some of the holes are elongated slots.

15. An adjustable hinge assembly as claimed in claim 12, said curb plates and said plates adapted to cooperatively define a pivot axis about which the cap can be pivoted relative to the curb between a closed position in which the cap covers the curb and an open position in which the cap is raised from the curb.

16. An adjustable hinge assembly as claimed in claim 15, further comprising a locking means for locking the support arms in the open position.

17. An adjustable hinge assembly as claimed in claim 15, wherein the support plates and the curb plates include holes that are aligned with one another in the open position of the support plates, the assembly further comprising a locking pin sized for receipt in the aligned holes to lock the support plates in the open position.

18. An adjustable hinge assembly as claimed in claim 15, wherein the support plates and the curb plates include holes that are aligned with one another in the closed position of the support plates, the assembly further comprising a locking pin sized for receipt in the aligned holes to lock the support plates in the closed position.

19. An adjustable hinge assembly as claimed in claim 12, wherein the back plate and the second arms of the support plates each include a set of mounting holes by which the back plate can be secured to the support plates.

20. An adjustable hinge assembly as claimed in claim 19, wherein at least some of the holes are elongated slots.

21. An adjustable hinge assembly for use on a ventilator apparatus, wherein the ventilator apparatus includes a curb, a removable curb cap covering the curb and presenting side and rear edges, and a ventilator supported on the curb cap, said assembly comprising:

a pair of laterally spaced curb cap support plates, each including a first arm adapted to be secured to the curb cap along one of the side edges of the cap, and a second arm adapted to be secured to the curb cap along the rear edge of the cap;

a back plate connected to and between the support plates along the rear edge of the cap, said support plates being adjustable relative to the back plate; and a pair of laterally spaced curb plates adapted to be secured to the curb and to pivotally support the curb support plates for pivotal movement between a cap-covering position and a cap-removed position; and a stop operable to limit the pivotal movement of the curb cap support plates in a direction corresponding to pivotal movement of the curb cap support plates from the cap-covering position to the cap-removed position so that the curb cap support plates are prevented from pivoting beyond the cap-removed position.

22. An adjustable hinge assembly as claimed in claim 21, said curb cap support plates including a third arm extending generally transversely to the first and second arms.

23. An adjustable hinge assembly as claimed in claim 22, said stop including a flange protruding from the third arm.

24. An adjustable hinge assembly as claimed in claim 23, said flange contacting said curb plate when the curb cap support plates are in the cap-removed position to thereby it the pivotal movement of the curb cap support plates.

25. An adjustable hinge as claimed in claim 21, further comprising at least one bracket adapted to be secured between the back plate and the ventilator, said bracket being selectively shiftable relative to the back plate in at least two dimensions.

26. An apparatus comprising:

a ventilator having a curb and a curb cap for covering the curb; and an adjustable hinge assembly for hingedly coupling the curb cap to the curb, said assembly having a pair of laterally spaced curb cap support plates secured to the curb cap, said assembly having a back plate connected to the curb cap support plates, said curb cap support plates laterally shiftable relative to the back plate.

27. An apparatus as recited in claim 26, further comprising a pair of laterally spaced support plates secured to the curb and pivotally coupled to the curb cap support plates.

28. An apparatus as recited in claim 27, said curb cap pivotable between a first position in which the curb cap covers the curb and a second position in which the curb cap is raised form the curb.

* * * * *